US012090378B2

(12) United States Patent
Sallinen

(10) Patent No.: US 12,090,378 B2
(45) Date of Patent: Sep. 17, 2024

(54) BASKETBALL HOOP STRUCTURE FOR A TRAMPOLINE

(71) Applicant: Acon Finland Oy Ltd, Oulu (FI)

(72) Inventor: Joel Sallinen, Liminka (FI)

( * ) Notice: Subject to any disclaimer, the term of this patent is extended or adjusted under 35 U.S.C. 154(b) by 0 days.

(21) Appl. No.: 18/076,584

(22) Filed: Dec. 7, 2022

(65) Prior Publication Data

US 2023/0173362 A1 Jun. 8, 2023

(51) Int. Cl.
*A63B 63/08* (2006.01)
*A63B 5/11* (2006.01)
*A63B 67/00* (2006.01)

(52) U.S. Cl.
CPC ..... *A63B 63/083* (2013.01); *A63B 5/11* (2013.01); *A63B 67/002* (2013.01); *A63B 2067/005* (2013.01)

(58) Field of Classification Search
CPC ..... A63B 63/08; A63B 63/083; A63B 5/11; A63B 67/002; A63B 2067/005
See application file for complete search history.

(56) References Cited

U.S. PATENT DOCUMENTS 2,512,417 A * 6/1950 Cook ..... A63B 63/083 473/487
2,786,678 A * 3/1957 Fink ..... A63B 63/083 248/315
3,210,079 A * 10/1965 Tryon ..... A63D 5/00 434/249
3,881,677 A * 5/1975 Ihlenfeld ..... A47C 7/62 248/311.2
4,183,522 A * 1/1980 Killen ..... A63B 63/083 473/483
4,218,058 A * 8/1980 Hilbert ..... A63B 63/083 473/488
4,433,839 A * 2/1984 Simonseth ..... A63B 63/083 473/481
4,613,136 A * 9/1986 Raba ..... A63B 63/083 473/483
D291,303 S 8/1987 Wood
D304,421 S * 11/1989 Holdaway ..... 248/312.1
4,896,992 A * 1/1990 Muhlethaler ..... F16B 12/36 403/403
4,973,054 A * 11/1990 Metrosky ..... A63B 21/1663 473/481
5,129,648 A * 7/1992 Sweeney ..... A63B 63/083 473/433
5,300,920 A * 4/1994 Caselli ..... A63B 63/083 473/480

(Continued)

OTHER PUBLICATIONS

Communication of Acceptance, Finnish Patent And Registration Office, Serial No. 20217187, dated May 16, 2022, Applicant: Acon Finland Oy Ltd.

*Primary Examiner* — Melba Bumgarner
*Assistant Examiner* — Amir A Klayman
(74) *Attorney, Agent, or Firm* — BelayIP

(57) ABSTRACT

A basketball hoop structure is described herein. The basketball hoop structure includes a frame, a rim, a backboard and a fixing arrangement having an elongated trough. The hoop structure may be fixed onto a support tube of a trampoline. The support tube includes two slits and a locking hole. The trough includes two locking plates and a locking pin. When the basketball hoop structure is fixed to the support tube, the locking plates are inside the slits of the support tube and the locking pin is inside the locking hole.

14 Claims, 5 Drawing Sheets

(56) References Cited

U.S. PATENT DOCUMENTS 5,476,266 A * 12/1995 Caruso ..... A63B 63/004 160/330
5,785,616 A * 7/1998 Dodge ..... A63B 63/083 473/479
5,876,084 A * 3/1999 Smith ..... B60R 13/0206 24/297
6,324,988 B1 * 12/2001 Svensson ..... F16B 7/182 403/292
6,881,162 B2 * 4/2005 Nye ..... A63B 63/083 473/481
6,899,645 B1 * 5/2005 Hsiao ..... A63B 63/004 273/400
7,175,551 B1 * 2/2007 Hamilton ..... A63B 63/083 473/486
7,300,059 B2 * 11/2007 Caruso ..... A63B 63/004 273/400
7,351,168 B1 * 4/2008 Pannell ..... A63B 63/004 273/400
9,084,908 B1 * 7/2015 Chen ..... A63B 5/11
9,452,334 B2 * 9/2016 Ko ..... A63B 63/083
9,545,552 B1 1/2017 Buchweitz, III
9,827,522 B2 * 11/2017 Simmons ..... F16B 11/006
10,258,854 B2 * 4/2019 Chen ..... A63B 5/11
10,300,977 B1 * 5/2019 Wang ..... B62J 50/40
10,398,956 B2 * 9/2019 Remaklus ..... A63B 63/083
10,401,131 B1 * 9/2019 Remaklus ..... F41J 1/10
2002/0187864 A1 * 12/2002 Griswold ..... A63B 63/083 473/483
2006/0058123 A1 * 3/2006 Publicover ..... A63B 63/083 473/485
2007/0204533 A1 * 9/2007 Gower ..... E06B 9/0692 52/202
2017/0203174 A1 7/2017 Chen
2022/0001226 A1 * 1/2022 Chen ..... A63B 71/022

* cited by examiner

BASKETBALL HOOP STRUCTURE FOR A TRAMPOLINE

CROSS REFERENCE TO RELATED APPLICATIONS

This application is a national filing based upon Finnish priority patent application FI20217187, filed Dec. 7, 2021, the content of which is herein incorporated by reference.

BACKGROUND OF THE INVENTION

Field of the Invention

The invention relates to a basketball hoop structure for a trampoline, and the basketball hoop structure comprises a frame, a rim and a backboard, and the trampoline comprises a trampoline frame having a horizontal support tube, and the cross-section of the support tube is circular, and the basketball hoop structure is configured to be fixed onto the support tube.

Trampolines are commonly used in outdoor and indoor activities. Trampolines comprise a frame structure and a mat connected to the frame structure with stretching elements such as springs or similar. The frame structure comprises transverse and horizontal tubes. Trampoline activities include playing basketball. A basketball hoop designed for trampolines include traditional basketball hoop parts such as a rim and a backboard and arrangements for attaching the basketball hoop to the frame structure.

Description of Related Art

Patent publication US20170203174 presents a basketball hoop that is fixable to a trampoline frame structure. The basketball hoop is fixed to the trampoline frame tubes by two arch members connected to the backboard. The construction is fragile and hard to assemble.

There is a clear need for a simple and reliable arrangement for fixing a basketball hoop to the trampoline frame.

BRIEF SUMMARY OF THE INVENTION

The object of the invention is a solution that can significantly reduce the disadvantages and drawbacks of the prior art. In particular, the object of the invention is a solution where a basketball hoop structure is provided that is easy to fix to the frame of the trampoline and is secure at the same time.

The objects of the invention are attained with a basketball hoop structure that is characterized by what is stated in the independent patent claim. Some advantageous embodiments of the invention are disclosed in the dependent claims.

The invention is a basketball hoop structure comprising a frame, a rim, a backboard, and a fixing arrangement comprising an elongated trough. The hoop structure is configured to be fixed onto a support tube of a trampoline. The support tube comprises two slits and a locking hole. The trough comprises two locking plates and a locking pin. When the basketball hoop structure is fixed onto the support pipe, the locking plates are inside the slits of the support pipe and the locking pin is inside the locking hole.

When reference is made in the text to the upper or the lower parts or respective directions such as down or up, a situation is described in which the basketball hoop structure according to the invention is in use and fixed to a trampoline frame. Also, when reference is made to the vertical or horizontal directions or surfaces, the basketball hoop structure is placed similarly.

In one embodiment of the invention is a basketball hoop structure for a trampoline, and the basketball hoop structure comprises a frame, a rim, and a backboard. The trampoline comprises a trampoline frame having horizontal support tube, and the cross-section of the support tube is circular. The basketball hoop structure is configured to be fixed onto the support tube. In one advantageous embodiment of the invention, the support tube is hollow and further comprises two slits on the upper surface of the support tube and a locking hole on the lower surface of the support tube. The basketball hoop structure further comprises a fixing arrangement that is attached to the frame of the basketball hoop structure, and the fixing arrangement comprises an elongated trough, and the trough comprises an inner surface of the trough, an outer surface of the trough, a first edge of the trough and a second edge of the trough. On the first edge are two locking plates: a first locking plate and a second locking plate, and the locking plates curve inward to the trough, i.e. toward the inner surface of the trough. and near the second edge is a locking arrangement comprising a locking pin. The fixing arrangement is configured in such a way that when the basketball hoop structure is fixed onto the support tube, the locking plates are inside the slits of the support tube and the locking pin is inside the locking hole.

In one embodiment of the basketball hoop structure, the basketball hoop structure is configured to be put in place with a setting rod. In a second embodiment of the basketball hoop structure, there is a rod receiving arrangement in the fixing arrangement for receiving an end of the setting rod. In a third embodiment of the basketball hoop structure, the rod receiving arrangement is configured in such a way that when the end of the setting rod is placed into the rod receiving arrangement, the longitudinal axis of the setting rod is parallel to the surface of the backboard. In a fourth embodiment of the basketball hoop structure, the locking pin is positioned inside the rod receiving arrangement, and the locking pin is configured to settle in the locking position and to release from the locking position with the setting rod.

These features provide improved placing and fixing of the basketball hoop structure onto the support tube of the trampoline.

In a fifth embodiment of the basketball hoop structure, the locking arrangement comprises a locking release arrangement, and the locking release arrangement is attached to the end of the locking pin. In a sixth embodiment of the basketball hoop structure, the locking release arrangement is a wire.

These features improve the locking and releasing of the locking arrangement.

In a seventh embodiment of the basketball hoop structure, the locking arrangement comprises a spring or a corresponding structure that is configured to force the locking pin into a locking position, and in the locking position the locking pin is partly above the inner surface of the trough. In an eight embodiment of the basketball hoop structure, the locking arrangement comprises an arrangement for pulling the locking pin into a position where the tip of the locking pin is at the level of the inner surface of the trough or below it.

These features further improve the locking and releasing of the locking arrangement.

In a ninth embodiment of the basketball hoop structure, the locking pin is between the first locking plate and the second locking plate.

This feature improves the balance of the fixing arrangement and the basketball hoop structure especially during placing and fixing of the basketball hoop structure.

In a tenth embodiment of the basketball hoop structure, the locking plates comprise straight parts, i.e., where the locking plates do not curve. In an eleventh embodiment of the basketball hoop structure, the angle between the tangent of the outer surface of the trough at the first edge of the trough and the straight part of the locking plate is in range of 70 to 90 degrees.

These features improve the stability of the basketball hoop structure when it is fixed to the trampoline.

In a twelfth embodiment of the basketball hoop structure, the cross-section of the trough is a half-circle.

In a thirteenth embodiment of the basketball hoop structure, the cross-section of the trough near the second edge of the trough is flat and the plane of the locking plate and the plane of said flat part of the trough are perpendicular. This feature makes manufacturing of the fixing arrangement easier and makes it more robust as well.

In a fourteenth embodiment of the basketball hoop structure, the fixing arrangement that is attached to the frame of the basketball hoop structure is near the lower edge of the backboard.

This feature makes placing of the basketball hoop structure easier, because the backboard will not block the line of the vision when the basketball hoop structure is about to be placed onto the trampoline frame.

In a fifteenth embodiment of the basketball hoop structure, the curvature of the trough matches the curvature of the outer surface of the support tube, or it is slightly larger.

This feature makes the placing the fixing arrangement easier. Also, the fixing arrangement is such that it prevents movements of the basketball structure and thus significantly reduces noises from the basketball structure.

It is an advantage of the invention that it provides a basketball hoop structure that is easy and fast to put in place and remove. It also produces a basketball hoop structure that has no complex parts, so that it is easier to manufacture and maintain than devices according to known techniques.

One advantage of the invention is that it improves safety.

It is a further advantage of the invention that it can be easily used with various types of trampolines.

BRIEF DESCRIPTION OF THE SEVERAL VIEWS OF THE DRAWINGS

Further advantages features and details of the various embodiments of this disclosure will become apparent from 11 the ensuing description of a preferred exemplary embodiment and with the aid of the drawings. The features and combinations of features recited below in the description, as well as the features and feature combination shown after that in the drawing description or in the drawings alone, may be used not only in the particular combination recited, but also in other combinations on their own, with departing from the scope of the disclosure.

In the following, the invention is described in detail. The description refers to the accompanying drawings, in which.

DETAILED DESCRIPTIONS OF THE INVENTION

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B, or C" then, unless specifically stated otherwise or infeasible, the component may include A, or B, or C, or A and B, or A and C, or B and C, or A and B and C. Expressions such as "at least one of" do not necessarily modify an entirety of the following list and do not necessarily modify each member of the list, such that "at least one of "A, B, and C" should be understood as including only one of A, only one of B, only one of C, or any combination.

The embodiments in the following description are given as examples only and someone skilled in the art can carry out the basic idea of the invention also in some other way than what is described in the description. Though the description may refer to a certain embodiment or embodiments in several places, this does not mean that the reference would be directed towards only one described embodiment or that the described characteristic would be usable only in one described embodiment. The individual characteristics of two or more embodiments may be combined and new embodiments of the invention may thus be provided.

Figure 1:
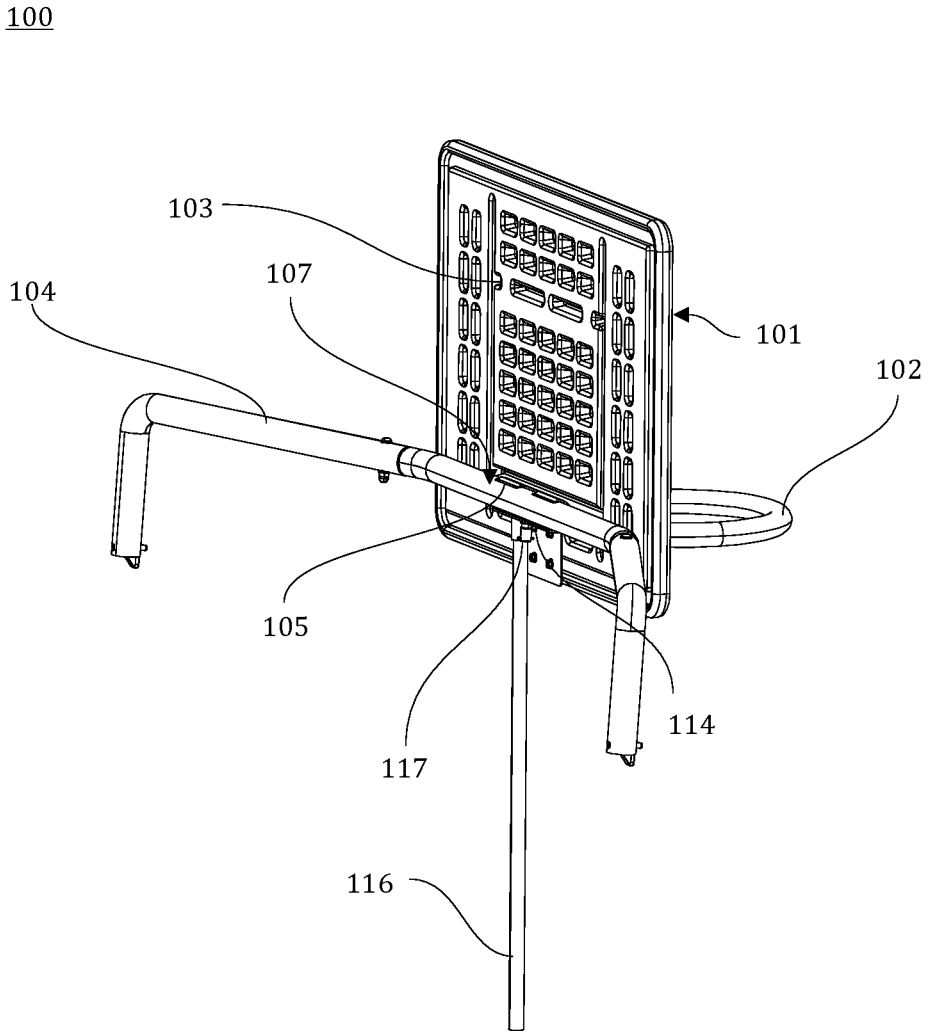
FIG. 1 depicts an example of a basketball hoop structure according to an embodiment.

FIG. 1 shows an embodiment of a basketball hoop 100 or a goal structure for a trampoline. The trampoline comprises a mat and a frame of the trampoline comprising a multitude of pipes or tubes. The frame of the trampoline comprises a multitude of transverse support tubes 104, i.e., horizontal tubes, and the level of the support tubes is above the mat. In some embodiments the support tubes are provided for attaching a safety net on the trampoline. The basketball hoop structure comprises a frame 101, a rim 102 and a backboard 103. The basketball hoop structure is configured to be fixed onto the frame of the trampoline and particularly onto the support tube or tubes. The frame connects the rim and the backboard and keeps the whole basketball hoop structure together. Also, the frame provides structural integrity for the basketball hoop structure.

The support tube 104 has an upper surface of the support tube and a lower surface of the support tube. Said surfaces are on opposite sides of the support tube. The cross-section of the support tube is circular. The support tube is hollow, and it further comprises two slits 105 on the upper surface of the support tube and a locking hole on the lower surface of the support tube. The longitudinal axes of the slits are parallel to the longitudinal axis of the support tube. The slits are consecutive, i.e., they both are in the same straight line. In some embodiments, the slits and the locking hole are opposite to each other. In some embodiments, the locking hole is closer to the surface of backboard 103 than the slits, when the basketball hoop structure 100 is fixed onto the support tube.

The basketball hoop structure 100 further comprises a fixing arrangement 107 that is attached to the frame 101 of the basketball hoop structure. The fixing arrangement is for fixing the basketball hoop structure onto the support tube 104. The fixing is done in such a way that the basketball hoop structure is detachable and reattachable. The fixing arrangement comprises an elongated trough 108 structure, and in some embodiments, additional arrangements for attaching the trough to the frame. The trough comprises an inner surface of the trough, an outer surface of the trough, a first edge of the trough and a second edge of the trough. In some embodiments, the trough is formed from a plate that is bent or pressed or otherwise transformed into a curved shape. Of course, the trough can also be manufactured from a tube with suitable dimensions by cutting the tube in longitudinally. The trough is attached to the frame in such a way that the trough is open toward the direction that is away from the backboard 103 and the longitudinal axis of the trough is parallel to the level of the backboard. The trough is configured to be placed onto the support tube and to be fixed to it. When the trough is fixed onto the support tube of the trampoline, the first edge is higher than the second edge. The shape of the cross-section of the trough is approximately a half-circle, i.e., the line from the first edge to the second edge travels approximately over or near the center of the curvature of the inner surface. Naturally, other kinds of cross-sections are possible as well. Advantageously, the curvature or shape of the inner surface of the trough follows the outer shape of the support tube 104.

On the first edge 110 are two locking plates: a first locking plate and a second locking plate (not visible in FIG. 1). The locking plates are flat teeth-like structures that extend from the first edge and the thickness of the locking plates and the trough 108 are the same or approximately the same. Advantageously, the locking plates and the trough are made in one piece, i.e., the locking plates are connected seamlessly to the first edge. Near the second edge 111 is a locking arrangement 114 comprising a locking pin (not visible in FIG. 1). The locking pin is in the area between the locking plates. The dimensions and positions of the locking plates are such that both locking plates fit into the slits 105. Each locking plate has its own slit. The locking plates turn inward toward the inner surface 109 of the trough, i.e., inside the trough.

When the basketball hoop structure 100 is to be fixed onto the support tube 104, first the locking plates are placed into the slits 105 on the support tube 104. During their placing, the basketball hoop structure is tilted from the vertical position (the position where the surface of the backboard 103 is vertical). The tilting direction is outward from the center of the trampoline, i.e., toward the direction where the side of the basketball hoop structure to which the rim is attached pivots on the upward side. When the locking plates are inside the slits, the basketball hoop structure is tilted back to the vertical position. The locking pin pivots toward the locking hole, and when the basketball hoop structure is in the vertical position, the locking pin can be fitted into the locking hole thus locking the basketball hoop structure to the support tube. In some embodiments the fixing arrangement 107 is attached to the frame 101 near the lower edge of the backboard 103.

In this embodiment, the basketball hoop structure 100 comprises a setting rod 116 for putting the basketball hoop structure in place. The fixing arrangement 107 comprises a rod receiving arrangement 117 where one end of the setting rod can be placed. Advantageously, the setting rod is fixed into the rod receiving arrangement in such a way that the basketball hoop structure can be moved and lifted by using the setting rod. The basketball hoop structure is lifted and tilted with the setting rod in such a way that the trough 108 is placed and fixed onto the support tube 104 as was described before. When the basketball hoop structure is in place the setting rod can be detached from the rod receiving arrangement. When the basketball hoop structure needs to be removed from the frame of the trampoline, the setting rod can be fixed to the rod receiving arrangement and, after the locking pin is released from the locking hole, it can be used to tilt and remove the basketball hoop structure in the opposite order as was described before.

Figure 2:
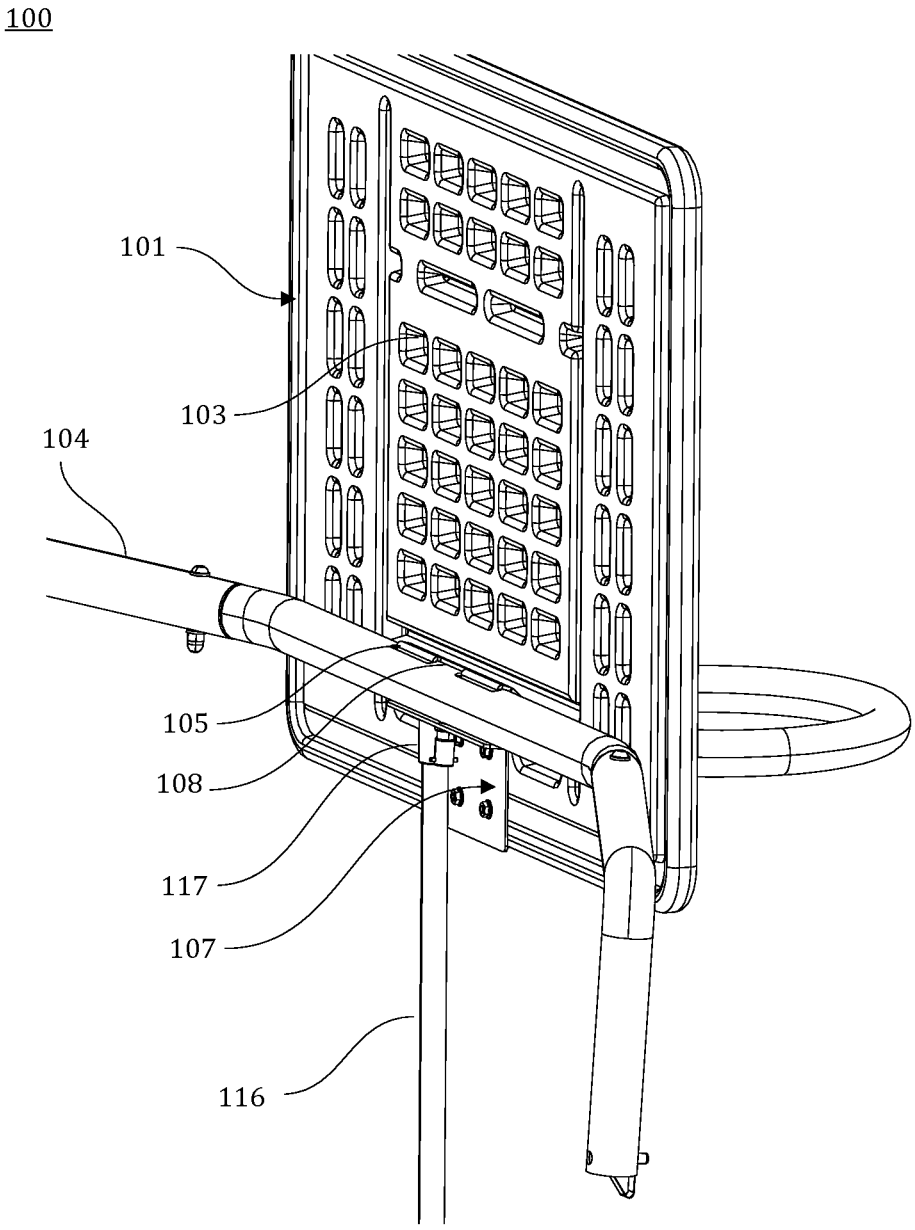
FIG. 2 depicts a close view of the basketball hoop structure as presented in FIG. 1.

FIG. 2 shows a detail of the basketball hoop structure 100 presented in FIG. 1 comprising the frame 101 and the backboard 103. The basketball hoop is fixed onto the support tube 104 with the fixing arrangement 107. The support tube comprises two slits 105 and the locking hole. The fixing arrangement comprises the trough 108 and an arrangement for attaching the trough onto the frame. The trough comprises two locking plates and the locking arrangement comprising the locking pin. The basketball hoop structure further comprises the setting rod 116 that is fixed onto the rod receiving arrangement 117. In some embodiments of the rod receiving arrangement, the locking pin is positioned in the rod receiving arrangement, and the locking pin is configured to settle in the locking position and to release from the locking position with the setting rod. This is implemented, for example, by a mechanism, where the locking pin is put in the locking position by rotating the setting rod and released by rotating the setting rod in the opposite direction.

Figure 3:
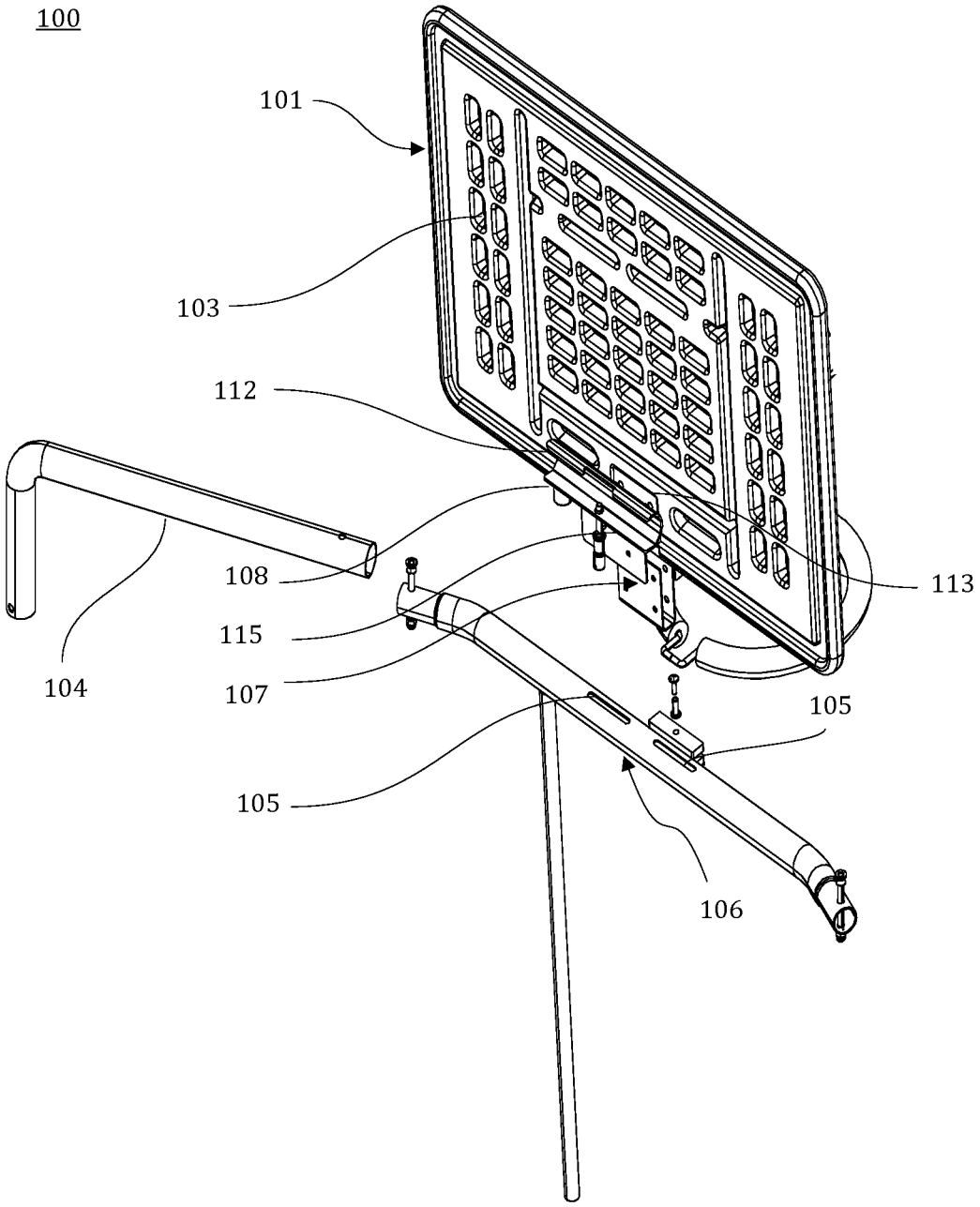
FIG. 3 depicts an exploded view of the basketball hoop structure presented in FIG. 1.

FIG. 3 shows an exploded view of the basketball hoop structure 100 as presented in FIG. 1. The support tube 104 comprises two slits 105 on the upper side of the support tube and the locking hole 106 on the opposite side to the slits.

The basketball hoop structure 100 comprises the frame 101, the backboard 103 and the fixing arrangement 107. The fixing arrangement comprises the trough 108, the locking arrangement, and an arrangement for attaching the trough to the frame. On the upper longitudinal side (the first side) of the trough are two locking plates: the first locking plate 112 and the second locking plate 113. In this embodiment the locking plates are situated at the ends of the trough. The locking arrangement comprises the locking pin 115. The locking pin is movable from a locking position. In the locking position, the locking pin is partly above the inner surface of the trough. In some embodiments the locking arrangement comprises a spring or corresponding structure that forces the locking pin into a locking position unless the force is cancelled in some way. This may be done, for example, by pulling at the locking pin. In some embodiments, this pulling is done with a locking release arrangement. The locking release arrangement is attached to the end of the locking pin 115. In some embodiments the locking release arrangement is a wire or a similar structure. When the locking pin is released from the locking position, the trough can be moved by rotating it together with the basketball hoop structure.

Figure 4:
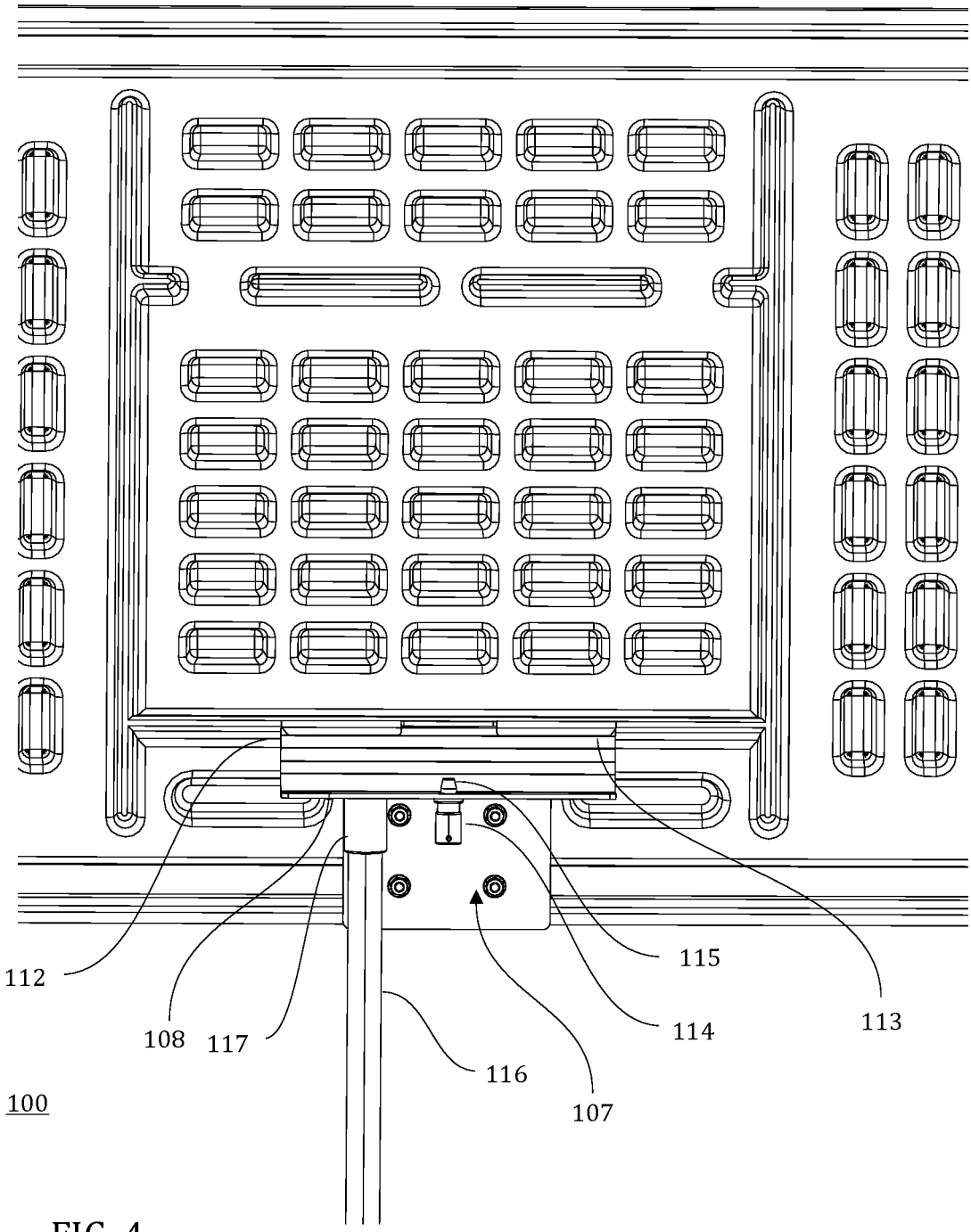
FIG. 4 depicts a second close-up view of the basketball hoop structure as is in FIG. 1.

FIG. 4 shows a detail of the basketball hoop structure 100 as presented in FIG. 1, focusing on the fixing arrangement 107. The fixing arrangement comprises the trough 108, the locking arrangement 114, and an arrangement for attaching the trough to the frame. The rod receiving arrangement 117 is attached to the fixing arrangement. In this example, the setting rod 116 is fixed to the rod receiving arrangement. The body of the trough is open to the direction that is away from the rest of the basketball hoop structure. On the upper edge of the trough (the first edge), there are two locking plates: the first locking plate 112 and the second locking plate 113. The locking plates curve inward. In some embodiments, the curvature of the locking plates varies at different places on the locking plates, i.e., the curvature need not be consistent as it can vary. At the very least, the curvatures of the locking plates are identical. The locking arrangement comprises the locking pin 115. In this example, the locking pin is in the locking position, i.e., the end of the locking pin is above the inner surface of the trough. When the basketball hoop structure is fixed onto the support tube of the trampoline, the locking pin is in the locking position and inside the locking hole of the support tube. When the basketball hoop structure is about to be detached, the locking pin is pulled at least so far that the end of the locking pin is on the level of the inner surface of the trough. When the locking pin is in said position, the basketball hoop structure can be moved in relation to the support tube.

Figure 5A:
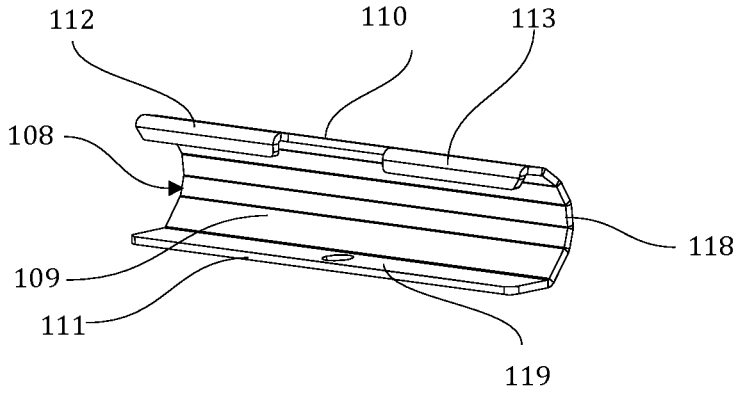
FIG. 5A depicts an example of the trough structure of the basketball hoop structure.
Figure 5B:
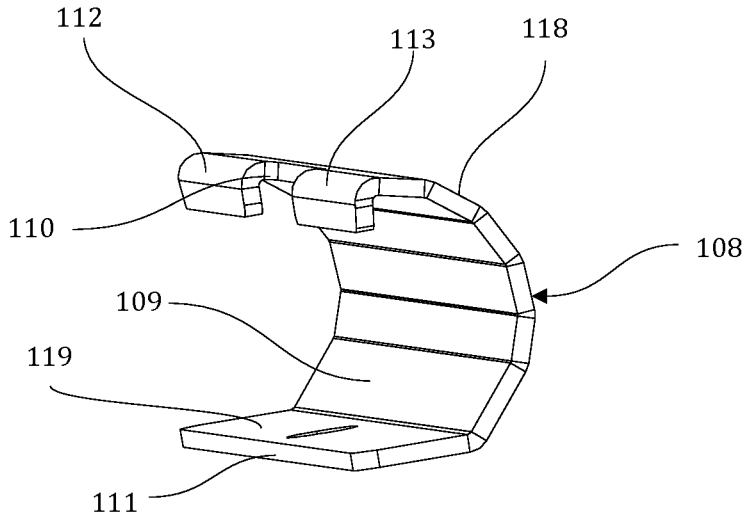
FIG. 5B depicts the trough structure of the basketball hoop structure presented in FIG. 5A as seen from the side.

FIGS. 5A and 5B show an example of an embodiment of a trough 108 that is an elongated straight structure having a body that has at least a partly curved cross-section. In FIGS. 5A and 5B, the trough is seen from different directions. The embodiment is mainly similar to what was disclosed in FIGS. 1 to 4, so the numbering corresponds with previous figures. The trough comprises an inner surface 109, an outer surface 118, a first edge 110 trough and a second edge 111. The first edge is configured to be higher than the second edge when a basketball hoop structure comprising the trough is fixed onto the trampoline support tube. On the first edge are two teethlike locking plates: a first locking plate 112 and a second locking plate 113. The locking plates rotate inward, i.e., toward the inner surface, and form a structure having a hook-like cross-section. In the embodiment shown FIG. 5 the locking plates are approximately straight, i.e., they have parts where the locking plates show no curvature. This part is a straight part of the locking plate. The angle between the tangent at the first edge and the straight part in this embodiment is a right angle (90 degrees). In some embodiments, this angle is in range of 70 to 90 degrees. When the angle is less than 90 degrees, the locking plates curve further inward, i.e., toward the inner surface. It must be noted that these angles are also applicable if the locking plates include curved parts. This means that the locking plate curves continuously or has parts that are curved. The line from the first edge to the second edge goes through the center of the curvature of the body of the trough or near it. The cross-section of the trough is therefore approximately a half-circle. The curvature of the body of the trough is the curvature of the outer surface of the support tube or slightly larger than that.

In this embodiment the trough 108 near the second edge 111 comprises a flat part 119. The flat part is flat, or its curvature radius is so much larger than the curvature radius of the curved part of the body of the trough, so that the flat part can be considered to be essentially flat. In this embodiment the plane of the locking plates 112, 113 and the plane of said flat part 119 of the trough are perpendicular. The flat part comprises a hole for the locking pin.

Some advantageous embodiments of the device according to the invention have been described above. The invention is however not limited to the embodiments described above, but the inventive idea can be applied in numerous ways within the scope of the claims.

Having described some aspects of the present disclosure in detail, it will be apparent that further modifications and variations are possible without departing from the scope of the disclosure. All matter contained in the above description and shown in the accompanying drawings shall be implemented as illustrated and not in a limiting sense.

What is claimed is:

1. A basketball hoop structure for a trampoline, the trampoline comprising a trampoline frame having a hollow horizontal support tube having a circular cross-section, an upper surface and two slits arranged on the upper surface, a lower surface and a locking hole arranged on the lower surface, the basketball hoop structure comprising:

a hoop structure frame;

a fixing arrangement attached to the hoop structure frame, the fixing arrangement comprising an elongated trough, the elongated trough having an inner surface, an outer surface, a first edge having a first locking plate and a second locking plate both configured to curve inward towards the inner surface, a second edge, a locking arrangement arranged near the second edge and comprising a locking pin;

a rim attached to the hoop structure frame; and a backboard attached to the hoop structure frame, and having a surface; and wherein the basketball hoop structure is configured to be fixed onto the hollow horizontal support tube; and wherein the fixing arrangement is configured such that when the basketball hoop structure is fixed onto the horizontal support tube, the first locking plate and the second locking plate are arranged inside the two slits and the locking pin is arranged inside the locking hole.

2. The basketball hoop structure according to claim 1, wherein the basketball hoop structure is configured to be attached onto a setting rod having an end and a longitudinal axis.

3. The basketball hoop structure according to claim 2, further comprising a rod receiving arrangement arranged in the fixing arrangement and configured to receive the end of the setting rod.

4. The basketball hoop structure according to claim 3, wherein the rod receiving arrangement is further configured such that when the end of the setting rod is arranged in the rod receiving arrangement, the longitudinal axis of the setting rod is arranged parallel to the surface of the backboard.

5. The basketball hoop structure according to claim 1, wherein the locking arrangement further comprises a locking release arrangement attached to the end of the locking pin.

6. The basketball hoop structure according to claim 5, wherein the locking release arrangement is a wire.

7. The basketball hoop structure according to any of claim 1, wherein the locking arrangement further comprises a spring configured to urge the locking pin into a locking position wherein the locking pin arranged partly above the inner surface of the trough.

8. The basketball hoop structure according to claim 7, wherein:

the locking pin comprises a tip; and the locking arrangement further comprises a pulling arrangement configured to pull the locking pin into a position where the tip is arranged level or below the inner surface of the trough.

9. The basketball hoop structure according to claim 1, wherein the locking pin is arranged between the first locking plate and the second locking plate.

10. The basketball hoop structure according to claim 1, wherein the the first locking plate and the second locking plate further comprise straight parts lacking curvature.

11. The basketball hoop structure according to claim 10, wherein an angle between a tangent of the outer surface of the trough at the first edge of the trough and a straight part of the first locking plate and the second locking plate are in range of 70 to 90 degrees.

12. The basketball hoop structure according to claim 1, wherein the trough comprises a half-circle cross-section.

13. The basketball hoop structure according to claim 1, wherein:

a cross-section of the trough near the second edge of the trough is flat, and the first locking plate and the second locking plate are arranged in a first plane, the trough comprises a flat part arranged in a second plane, and the first plane is arranged perpendicular to the second plane.

14. The basketball hoop structure according to claim 1, wherein the backboard comprises a lower edge and the fixing arrangement is arranged attached to the frame near the lower edge of the backboard.

* * * * *